US005447007A

United States Patent [19]

Reil et al.

[11] Patent Number: 5,447,007

[45] Date of Patent: Sep. 5, 1995

[54] DEVICE FOR FILLING AND CLOSING PACKS FOR LIQUIDS

[75] Inventors: Wilhelm Reil, Bensheim; Ulrich Deutschbein, Muhltal; Udo Liebram, Pfungstadt; Gerd Knobloch, Griesheim, all of Germany

[73] Assignee: Tetra Laval Holdings & Finance S.A., Pully, Switzerland

[21] Appl. No.: 856,920

[22] PCT Filed: Nov. 22, 1991

[86] PCT No.: PCT/DE91/00923

§ 371 Date: Jul. 20, 1992

§ 102(e) Date: Jul. 20, 1992

[87] PCT Pub. No.: WO92/20580

PCT Pub. Date: Nov. 26, 1992

[30] Foreign Application Priority Data

May 18, 1991 [DE] Germany ..... 41 16 370.2

[51] Int. Cl.[6] ..... B65B 61/18

[52] U.S. Cl. ..... 53/133.2; 53/251; 53/282; 53/299; 53/319

[58] Field of Search ..... 53/89, 90, 97, 133.2, 53/133.4, 167, 251, 267, 282, 299, 319, 296, 297, 298, 245, 248

[56] References Cited

U.S. PATENT DOCUMENTS

| | | | |
|---|---|---|---|
| Re. 32,018 | 11/1985 | Domke et al. | 53/480 |
| 2,167,894 | 8/1939 | Kotcher | 53/319 |
| 2,972,184 | 2/1961 | Andrew | 53/133.2 X |
| 3,020,939 | 2/1962 | Donofrio | 141/169 |
| 3,244,576 | 4/1966 | Swartz | 156/513 |
| 3,434,908 | 3/1969 | MacDonald | 156/514 |
| 3,492,779 | 2/1970 | Russell | 53/245 X |
| 3,593,488 | 7/1971 | Merkner et al. | 53/245 X |
| 3,712,017 | 1/1973 | Knabe et al. | 53/319 X |
| 4,506,489 | 3/1985 | Schieser et al. | 53/319 X |
| 4,525,978 | 7/1985 | Hayase et al. | 53/167 |
| 4,566,251 | 1/1986 | Spisak et al. | 53/167 |
| 4,788,811 | 12/1988 | Kawajiri et al. | 53/133.2 X |
| 4,807,421 | 2/1989 | Araki et al. | 53/167 |

FOREIGN PATENT DOCUMENTS

| | | |
|---|---|---|
| 574837 | 7/1988 | Australia . |
| 0188153 | 3/1989 | European Pat. Off. . |
| 0450146A1 | 10/1991 | European Pat. Off. . |
| 7228201 | 3/1973 | France . |
| 2482554 | 11/1981 | France . |
| 1782777 | 10/1972 | Germany . |
| 3531728A1 | 3/1986 | Germany . |
| 3610362A1 | 10/1987 | Germany . |
| 3701915A1 | 8/1988 | Germany . |
| 437108 | 11/1967 | Switzerland . |
| 1030643 | 5/1966 | United Kingdom . |

*Primary Examiner*—Lowell A. Larson
*Assistant Examiner*—Daniel Moon
*Attorney, Agent, or Firm*—Michael L. Dunn; Robert P. Simpson

[57] ABSTRACT

A machine for filling and closing packs for liquids, wherein an opening is arranged in an upper surface which can be connected to a pouring device. The device has a first feed conveyor (3) with a base for open, empty packs (8). It has a conveyor (12) for intermittently moving the packs (8) from a base position (I) into individual intermediate positions (II–X, XI), an end position (IX), and has a filler station, a stoppering station and a carry off conveyor (25). A transverse sliding conveyor is arranged in the path of movement behind the feed conveyor (3), and transverse conveyors and entrainment devices are arranged between the feed conveyor (3) and the carry off conveyor (25) for the purpose of intermittently moving transportation boxes (14), and, in addition, the filler and stoppering stations are arranged in the region of the transverse conveyors at a level above the transportation boxes (14).

9 Claims, 9 Drawing Sheets

DEVICE FOR FILLING AND CLOSING PACKS FOR LIQUIDS

BACKGROUND OF THE INVENTION

The invention relates generally to a device for filling and closing liquid packs, and, more particularly, to a device for filling and closing packs for liquids, wherein there is an opening on the upper surface of the pack, and wherein the upper surface is adapted to be joined to a pouring device.

Devices already exist for filling and closing liquid packs like the afore-mentioned kind, wherein the entire upper surface of a pack is injected during an initial stage, whereupon liquid is filled from the oppositely disposed side, still open, of the casing which is closed first of all on one side by the lid, and the casing is then closed. With this, and with other known manufacturing machines, the process takes place along a conveyor device in a line. Thus, after an empty pack has been supplied, a cover is welded onto it, and than a cover is welded onto the next pack likewise, and so on and so forth, whereupon one pack after another is filled and finally closed.

It is true that a variation to these manufacturing machines has already been implemented, with a plurality of mutually adjacent mandrel wheels being arranged on a common axis of rotation, so that four casings, for example, are provided simultaneously with a lid which is injected thereon, whereupon the filling process and the like take place in four lines instead of one. These manufacturing machines are very expensive, however, particularly since four injection machines have to be provided on the four mandrel wheels.

SUMMARY OF THE INVENTION

The invention relates to a device for filling and closing packs for liquids, wherein on the upper surface there is an opening, and wherein the upper surface can be joined to a pouring device, the device having a) a first feed conveyor with a base for open, empty packs, b) conveyors for intermittently moving packs from a base position into individual intermediate positions and an end position, c) a filler station, d) a stoppering station and e) a carry off conveyor.

The aim of the invention is to create a filler and stoppering device of the afore-mentioned kind which can process a high number of packs reliably per unit of time.

This problem is solved according to the invention in that provided in the path of movement behind the feed conveyor is a transverse sliding conveyor, and provided between the feed conveyor and the carry off conveyor at a level beneath the base are transverse conveyors and entrainment devices for intermittently moving transportation boxes, and at a level above the transportation boxes is an intermediate conveyer, and characterised in that the filler and stoppering station are arranged in the region of the transverse conveyors at a level above the transportation boxes.

In the case of the device according to the invention, three conveyance directions are of importance in understanding the following description. Of these conveyance directions, the longitudinal conveyance direction is that of the feed conveyor, and is also termed the main conveyance direction. Extending transversely thereto is the transverse conveyance direction which is substantially vertical to the longitudinal conveyance direction. Both directions, namely the longitudinal conveyance direction and the transverse conveyance direction, are disposed in the horizontal planes. In addition, a third direction is provided which extends vertically to the longitudinal and transverse directions, this third direction being disposed in the vertical plane according to a preferred embodiment, of which particular consideration will be taken in that which follows. In the longitudinal direction of conveyance, the feed conveyor guides the open, empty packs into a base position. Thence a transverse sliding conveyor is responsible for pushing the row of at least two packs in the transverse direction of conveyance, i.e. transversely with respect to the first longitudinal conveyance direction.

A method is admittedly known in conveyance technology whereby machines are provided with a first conveyance direction which is vertical to a second one. However, the important feature in the device according to the invention is the fact that a row of at least two packs, preferably even eight or ten packs, is processed in stages. For this reason, the device can clearly be described in terms of the way in which a row of packs is supplied in the longitudinal conveyance direction to a kind of distributor, wherein further conveyance is in the longitudinal and transverse directions by means of the aforementioned conveyor. The conveyor means preferably operate intermittently. The filler and stoppering device according to the invention is particularly expedient for coupling downstream of a pack manufacturing machine, from which machine a row of packs issues by stroke movement. A manufacturing machine such as this can be a heat shaping machine, for example. In the case of the present invention, a first row of packs is supplied longitudinally in a visible line into a base position. This row of packs, can, for example, be in one piece, i.e.—this being necessitated by the manufacturing process in the heat-shaping machine—with one pack in the row being held onto the others. This is also the case with a row of, for example, ten packs. This integrated row is advantageous with respect to the filler and stoppering device under consideration here because of the accurate adjustment made to the individual processing units above the work pieces, i.e. above the packs, e.g. the adjustments made to the openings in the upper surfaces. If these ape a fixed distance inside a row of packs, correct gripping of the work pieces by the work tools is better ensured.

Starting from the afore-described base position, the rows of packs are advanced by stroke movement, of intermittently, in the so-called distributor in the longitudinal and transverse directions of conveyance. Whereas the transverse sliding conveyor and the carry off conveyor engage at various heights on the pack of the row of packs and displace them, different positions in height are distinguished according to the invention for the base. Beneath the base, that is to say in a plunged position, there are transverse conveyors and entrainment devices because these indirectly move the transportation boxes and thus the packs standing in the transportation boxes; whilst the intermediate conveyors and preferably also the feed- and carry off conveyors are provided above the level of the base, mope specifically at a level which is even above the transportation boxes. This design means that, according to the invention, the conveyors mentioned latterly which engage in packs above the upper edges of the transportation boxes have no influence over movement of the transportation boxes and do not engage in them.

Also, a further height level is expedient which is disposed up above the conveyors and even up above the transportation boxes, even at a spacing above the upper surfaces of the packs which are to be transported, that is to say the level for the filler and stoppering station. It is to be appreciated that even when the conveyors and/or transportation boxes are filled with packs, they can be guided beneath the filler and stoppering station, and removed them therefrom, without engaging there. In order to engage with the filler and stoppering station, some elements of the device according to the invention engage with the workpieces, in the above-described vertical direction of movement i.e. with the packs, as remains to be described.

By way of the device according to the invention, it is not only possible to reliably process a large number of packs per unit of time, but also parts of the device are designed in very advantageous ways in various respects. The particular arrangement of the conveyance elements means that the cycles are staggered in such a way that packs in a pack manufacturing machine can be further processed in a much improved manner, e.g. the respective packs can be filled slowly, carefully transported and closed so that they are liquid-tight. By virtue of the special kind of conveyance and thus distribution of the rows being processed, the cycle time available is increased. If the row of packs in question is supplied from the heat-shaping machine every four seconds, for example, then this row of packs would have to be further processed in four second cycles. By way of the features according to the invention, it is possible to make optimum use of the four seconds available. A larger part of the time can be used, for example, for longer movement, gluing or filling processes, Shorter processing cycles are adequate for transfer processes across only short paths. With longer rows of packs, where there are ten packs in one row, for example, conveyance can be seen in the longitudinal direction of conveyance, thus in the longitudinal extent of the row. This is a slower process than conveyance of the row in the transverse direction of conveyance, when the row only has to be displaced in the transverse direction of conveyance through the approximate size of its width, for example. Thus, with the preferred embodiment, where the pack manufacturing machine operates in a four second cycle, the entire cycle is divided up such that three seconds are taken up for conveying the row of packs in the longitudinal direction of conveyance or for the filling or closing processes, and the rest or intermediate amount of a second is taken up to move the respective row of packs in the transverse direction of conveyance.

By way of the aforementioned measures according to the invention it is thus possible to handle and manufacture a plurality of packs simultaneously in a plurality of processing stations, resulting in a high performance machine wherein a high number of packs can be processed reliably per unit of time. It is reliable, in particular, because sufficient time is available for filling and stoppering the individual packs.

It is also expedient according to the invention if the transportation boxes are each upwardly open containers of U-shared cross-section, and in length are equal to the longest row of packs to be conveyed. Processes using devices with a row of ten packs in one piece have already given a satisfactorily high output. In such cases, the respective transportation box is of a length such that the aforementioned ten packs, i.e. the integrally formed row of packs, is completely accommodated in the transportation box. Expediently, the transportation box is open at the front and back longitudinally, as well as at the top. In this way, when the transportation box is stationary, the row of packs can be pushed in from one side, and later conveyed away in the other direction. This displacement of the row of packs into and out of the transportation boxes is carried out, to use the terminology of this specification, by the intermediate conveyor and by the carry off conveyor. Both are able to engage with the packs, without touching the transportation boxes. The transverse conveyors and entrainment devices are controlled in such a way that at a given moment an empty transportation box is present in the operative region of the intermediate conveyor, and that simultaneously a full transportation box is present in the operative region of the carry off conveyor, so that when the two conveyors are switched on the one transportation box is loaded and the other is unloaded. When the transportation boxes move, one transportation box is empty at the end of each cycle.

The invention is particularly advantageously further designed in such a way that two transverse conveyors are arranged behind each other in the direction of conveyance of the feed conveyor, the transverse conveyors each conveying in opposite directions and having between their end positions at least one intermediate position beneath the filler station or beneath the stoppering station. It is to be appreciated that the transverse conveyors convey in the transverse direction, so that in accordance with the aforementioned first feature, during movement, the first transverse conveyor conveys the respective transportation box to the left into at least one intermediate position, and then conveys it further into an end position, whilst the second transverse conveyor disposed behind it conveys the transportation box disposed in the region of the second transverse conveyor, preferably synchronously, transversely to the right into an intermediate position, and then into an end position to the right. The cycle time of each transverse conveyor is one second, whilst the transportation boxes remain in the position of rest for three seconds before the next movement cycle of the transverse conveyor (one second long) begins. Therefore, three seconds are available both for the filler station and for the stoppering station —sufficient time for careful and successful processing.

In practice it is expedient, if, with each of the two transverse conveyors two intermediate positions are arranged between the two end positions, wherein the filler and stoppering station is provided in the one intermediate position, and wherein pause times are provided in the other intermediate position, partly for hardening or for further processing operations which are not described here. If there are two intermediate positions, there are a total of four positions for each of the two transverse carriers, namely the two end positions and the two intermediate positions.

According to the invention, it is also advantageous, if, arranged in the direction of conveyance of the feed conveyor, transversely to one another, are two entrainment devices which respectively convey in opposite directions so as to bring the transportation boxes from one transverse conveyor to the other. In this way, each transportation box can be moved along the line of a rectangle, e.g. first of all transversely to the left, and then parallel to the longitudinal conveyance direction and straight on, and then from the second transverse conveyor back to the right, from the second entrainment device opposite the longitudinal direction of conveyance, to the front etc. This movement of the transportation boxes permits the rows of packs like those described here to be suitably received, prepared and carried off, and it is possible to use two less transportation boxes because positions of rest are provided for the two transverse carriers.

It is also favourable according to the invention if the transverse conveyors and entrainment devices, and preferably also the transverse sliding conveyor and/or the carry off conveyor, have continuous belts which run around horizontally arranged axes. This is the simplest kind of conveyance device, and it has been shown to be particularly expedient if the intermediate conveyor and feed conveyor, and possibly also the carry off conveyor, have continuous belts which run around vertically arranged axes. In order to make particular savings on space, the rows of packs can thereby be moved in a longitudinal direction of conveyance to which a plurality of transverse conveyor components are added in order to smoothly and carefully empty filled contents, and to be able to close the filled packs.

It is expedient according to the invention, if, provided beneath the contact surface of the transportation box are openings for receiving entrainment members arranged on the entrainment devices. The contact surface of the respective transportation box is disposed approximately at the level of the aforementioned base, and the transportation box itself touches guides and/or entrainment devices which have to operate in stroke motion with the transverse conveyors without disturbance on either side. The entrainment members on the entrainment devices can therefore be short bars, which in length extend in the transverse direction of conveyance. It is therefore ensured that the transportation boxes are conveyed longitudinally through the entrainment devices because the force introduced by the entrainment members is guided into the openings and thus the contact surface of the transportation boxes; whereas the transverse conveyors can operate without disturbance because they push the respective transportation boxes out of the entrainment members and hold them freely in the intermediate position(s), before the transportation box is pushed by the entrainment members of the entrainment device into the end position. It has already been mentioned hereinabove that the starting position, as viewed in the direction of movement of the transverse conveyor, must be empty when the transverse conveyor is at a standstill. Thus, when the entrainment devices are switched on, this empty position is filled, whereupon the transverse conveyors can be switched on when the entrainment devices are at a standstill. Friction-free movement of the respective transportation box in the rectangular track is thus easily ensured.

The invention is also designed such that conveyors and entrainment devices are arranged within an aseptic space closed off by a housing with conduits. Depending on the arrangement of the conduits, feed conveyors or carry off conveyors can be arranged at least partly outside the aseptic space. However, the other conveyors, at least, are disposed completely inside the space which can be sealed from external air by a housing and which can then be sterilised. If, for example, the intention is to fill so-called H-milk in a dairy, which is transported and stored in aseptic packs, then it is possible to use the device according to the invention for use of these packs and the afore-mentioned product.

It is also advantageous, if, according to the invention, arranged adjacent to the stoppering station, at a distance therefrom is at least one roller with a wound up strip of pouring devices with a rotating axis arranged horizontally and in the direction of conveyance of the feed conveyor. In a row of packs to be processed, a corresponding number of rollers is disposed adjacent to one another on the rotating axis disposed in the direction of longitudinal conveyance, wherein one track can be supposed as being parallel to the actual longitudinal conveyance devices, e.g. parallel to the feed- or carry off conveyors. A test machine according to the device described here operates advantageously and satisfactorily, for example, with a row of ten packs and thus also with ten rollers and with ten coiled strips of pouring devices.

It is also expedient according to the invention if each filler device of the filler station has a vertically downwardly extending filler tube, and if arranged beneath and/or adjacent to the standing rails in the region of the filler device is a lifting mechanism for lifting the row of packs up over the filler tubes. If the device according to the invention is used for the manufacture of milk packs, or if the liquid of the packs in question is juice, or the like, care should be taken that the filler material is filled in foam-free manner. For this purpose, it is expedient if the pack is filled by the use of a filler tube in such a way that relative movement between the filler tube and the pack is controlled in such a way that the open, bottom end of the filler tube is near the vertical bottom of the pack at the start of the filling process, and takes into consideration the filling level during the filling process, and is brought up until the pack is full, and the flow of contents is stopped by the filler tube. Only then should the filler tube be withdrawn from the opening in the top of the pack. This is done, according to the invention, by means of the afore-described lifting mechanism which lowers the pack. In this way, both the filler device and filler tube can be arranged so that they are stationary. This simplifies the design of the filler.

With another advantageous embodiment of the invention, the stoppering station has conveyance means for the pouring devices which are to be placed on the filled packs, which pouring devices have a continuous belt with outwardly projecting, springy clamping receivers, wherein it has strippers which are movable vertically and in the region of the empty belt of the continuous belt which is movable close above the packs, and vertically movable sliders are provided to push the pouring device onto the clamping receivers. The pouring devices can be placed and fixed in the hole of the upper surface of the pack in other ways as well. However, a preferred embodiment has the feature described hereinabove.

The pack which is to be processed here is in the form of a four-walled structure, in the horizontally disposed flat upper surface of which there is an opening through which the filler tube of the filler device passes, so that after the filling process the pack is not closed in the region of its opening. In the stoppering station, the opening is covered by pouring devices being supplied, placed on the pack and stuck there. The pouring device can clearly be designed in various ways. The main thing of importance is that a stopper is contained for sealingly stoppering the pack. The pouring device can also be a bottom part provided with a hole and it can have a stopper pivotally connected thereto, which closes the hole so that it is liquid-tight. Thus, the whole unit of bottom part and stopper can be termed as the aforementioned pouring device.

A strip of pouring devices placed in succession behind one another can be coiled around a roller in various ways, and held so that it is mounted in the device according to the invention on the above-described rotating axis. The strip of pouring devices is thus supplied transversely to the longitudinal direction of conveyance.

With another embodiment of the device according to the invention which has already been successfully tested by the inventors the pouring devices are brought by a continuous belt above the row of packs until a pouring device is present on a clamping device in the correct position above each pack in a row. Then—when the continuous belt is, of course, still at a standstill, and also the packs —on actuation of the strippers all pouring devices are pressed onto the respective holes of the filled packs. The packs are thus closed. To have a device which operates sensibly and with a high output, the stoppering station must be of a correspondingly high output. To this end, the strip of pouring devices is guided intermittently over the holes in the upper surfaces of the packs, and with one embodiment the pack is pressed from underneath onto the pouring device, and with the other embodiment sliding members operating from beneath in the upward direction substantially vertically push the pouring devices onto a clamping receiver of a continuous strip which projects downwardly.

If the pouring devices are supplied in strip form they clearly have to be separated. This is done by the use of a blade. With one particular embodiment, the individualised pouring devices are pressed onto the clamping receivers. The strippers then become operative and they can be designed very simply as rails extending over the whole row of packs or along the continuous belt close above the upper surfaces of the rows of packs.

It is also advantageous according to the invention if the stoppering station has two processing stations arranged in the transverse extent behind each other, of which the first is provided to position the pouring device by means of the second conveyor, the clamping receiver and the stripper, and of which the second is provided for arranging the pouring device which is to be placed in the opening in the upper surface of the pack, wherein this second processing position has another lifting mechanism for the row of packs.

With another embodiment, not described here, the pouring devices have to be inserted and then firmly welded. If, thus, according to the invention, two intermediate positions are provided in the region of the transverse conveyors, then it is also possible to provide sealing means in the second intermediate position. With another embodiment it is expedient to fixedly glue the pouring device. The second intermediate position can then be used in the region of the transverse conveyor for hardening because additional time is available. The lifting mechanism described is expedient because it can be used either to lift the packs onto the pouring devices in the case of the gluing process, and to engage the edge of the upper surface with the pouring device; or it can be used for the purpose of sealing, subsequent to the lifting process, with the other embodiment.

The afore-described device is particularly suitable for use when packs are being manufactured, wherein the packs consist entirely of plastics material, including the pouring device which is put on in the stoppering station. The packs can, for example, be formed in a heat-shaping machine by deep-drawing from two open shells which are welded together to produce the pack, wherein only the hole is left open in the upper surface of the pack. The hole is used to fill the pack, and the hole is then closed in the above-described way.

The afore-mentioned use is particularly advantageous for a plastics material which is deep-drawable and which is preferably a thermoplastics material, e.g. polypropylene. PVC can also be used as the plastics material, wherein polypropene is widely known as polypropylene in the art. The pack which can be closed with the device according to the invention thus consists of parts and materials which can be recycled properly and which can decompose easily (in contrast to composite materials such as parer with plastics material). With a particularly preferable embodiment, according to the invention the plastics material e.g. the polypropene can also be filled, wherein the fillers can be chalk, mica, talc, gypsum or the like. Practice has shown that filling degrees of up to 70% are favourable, preferably 60%. It has been shown that these kinds of filled plastics materials can decompose easily, on the one hand, easily and by the use of methods, and that they can be reworked or recycled and also that the properties of the plastics material are not lost, so that these kinds of filled plastics materials are, in particular, deep-drawable and also capable of sealing.

The concept of the invention is thus concerned with the use of a filler and stoppering device of the kind mentioned in the introduction for manufacturing packs which are made entirely of deep-drawable plastics materials which, including the stopper, can seal and which are filled in the way described hereinabove.

Further advantages, features and possible applications of the present invention will emerge from the following description of a preferred embodiment, given in conjunction with the accompanying drawings, wherein:

BRIEF DESCRIPTION OF THE DRAWINGS

FIGS. 7 & 8 show illustrations of another embodiment for placing the pouring devices in the holes in the upper surfaces of a pack, wherein FIG. 7 shows the separating blade and the slider, FIG. 8 shows an illustration of three successive processing positions, wherein, from the right to the left are shown, firstly, the filling position, then the position where the pouring device is put on, and then, to the left, the position for welding, with this particular embodiment.

DESCRIPTION OF THE PREFERRED EMBODIMENT

Figure 1:
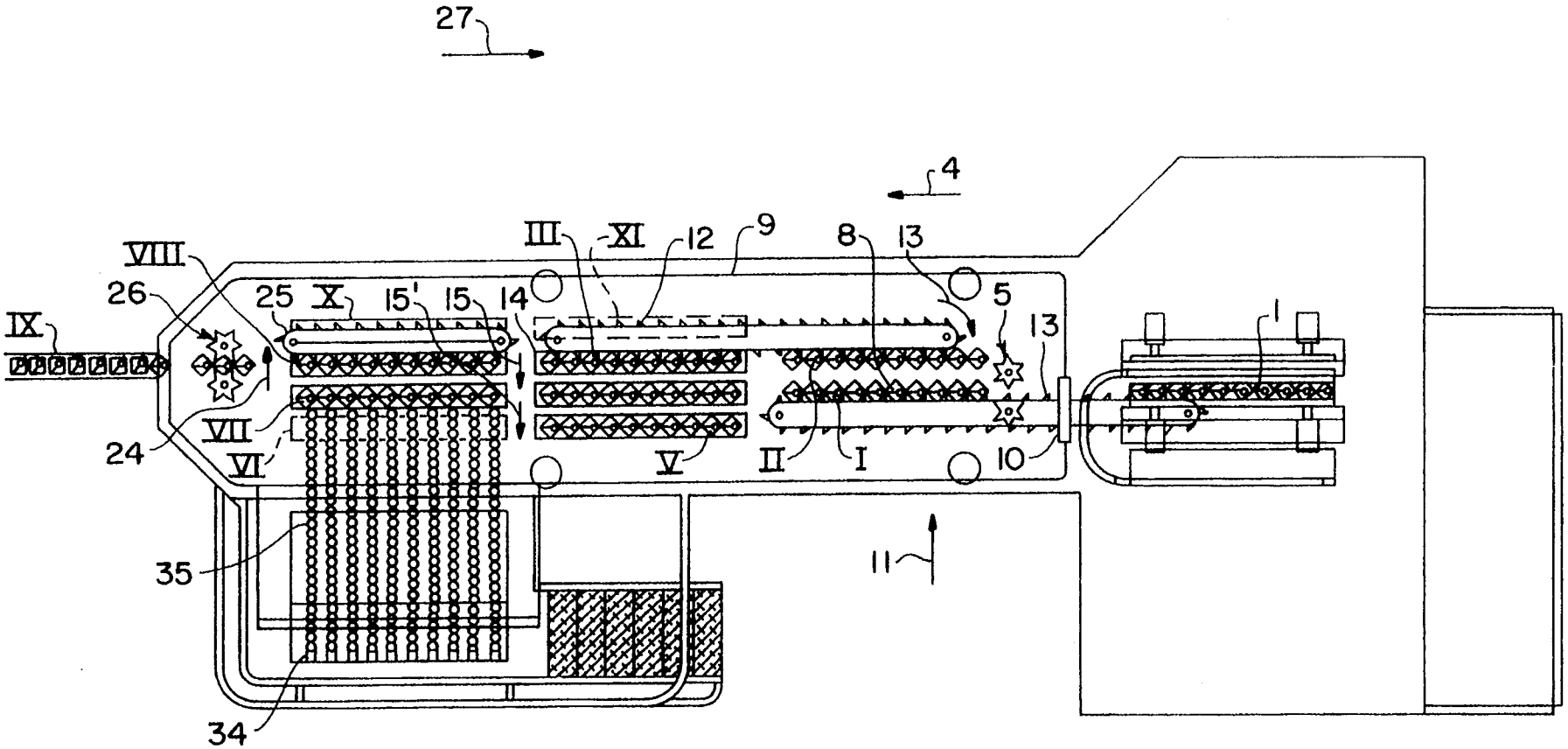
FIG. 1 shows the plan view of a filler and stoppering device of a preferred embodiment, wherein the longitudinal conveyance direction is that of the feed conveyor to the right and is oriented to the left, where the carry off conveyor can be seen to the left.
Figure 2:
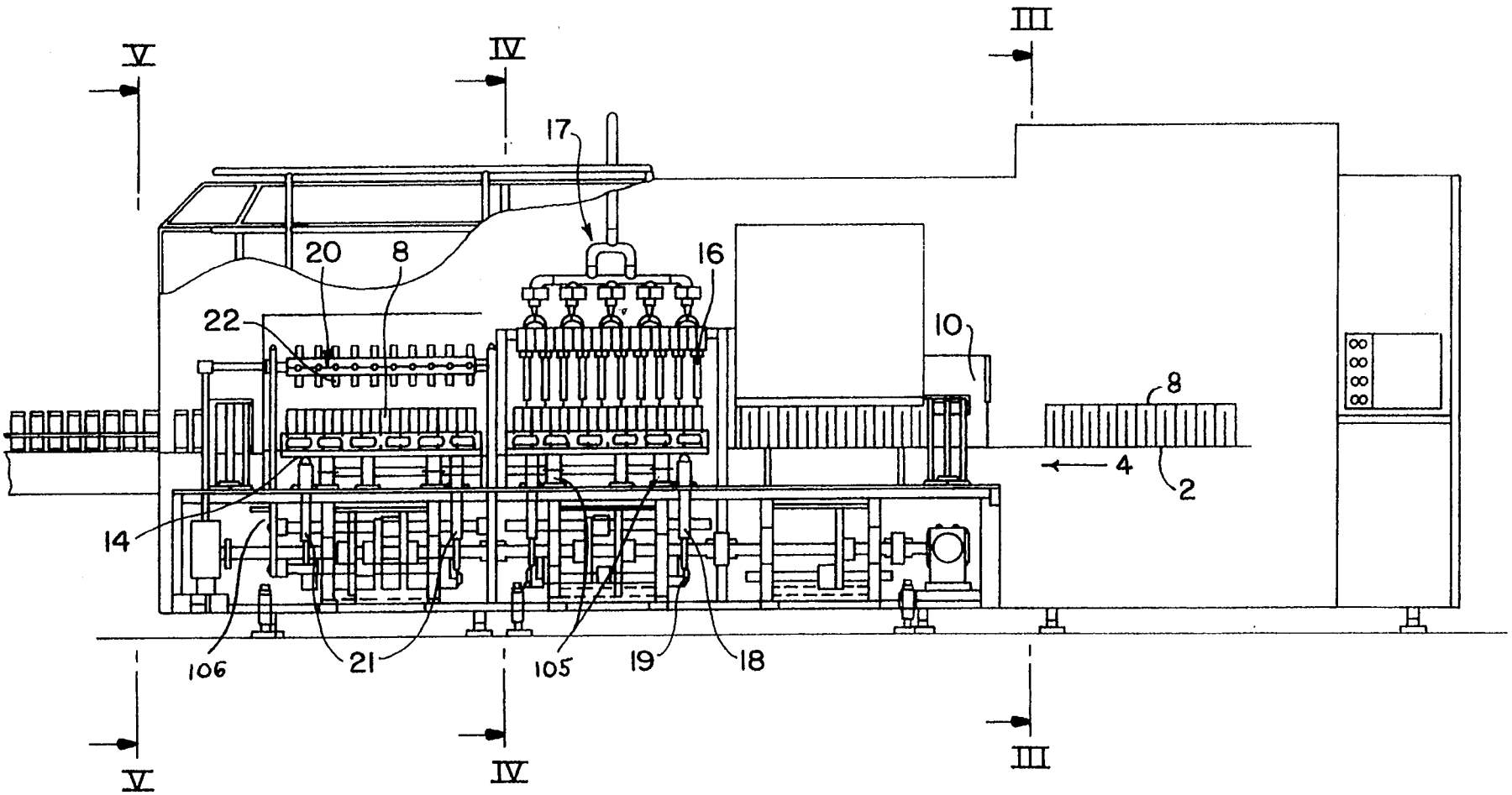
FIG. 2 shows a side view of the device, looking from the bottom to the top in FIG. 1.

A row of, for example, ten connected packs 8 placed on a bar-like base 2 issues from a deep-drawing and shaping device 1 which is only shown schematically in FIGS. 1 to 3 and 6. As shown in FIGS. 1 and 2, the row of packs 8 is then withdrawn in the direction of the arrow 4 by the feed conveyor 3 in the form of a transportation belt with direction-changing wheels mounted about vertical axes. A stamping device 5 consisting of two pairs of planetary rollers arranged from each other at a spacing equal to the height of a pack, stamps out the triangle 7 (above) and 7' (below) in the pack 8 shown in FIG. 12, during movement in the direction of the arrow 4. The row of packs 8 thus moves to the left into Position I and stops there. It is to be appreciated that both the feed conveyor 3 and also the other conveyors and entrainment devices are driven in stroke motion intermittently, in such a way that e.g. the row of packs 8 which is taken from the bottom of the deep-drawing and shaping device 1 moves forward to Position I and is stopped in that position.

If processing is aseptic, then the entire sterile space is closed off by a sealed housing 9. A conduit is provided at 10, through which the row of packs 8 pass when they move into the housing 9. The atmosphere in the aseptic housing 9 is sterile and there is a slight overpressure in comparison with the external atmosphere.

In Position I, the packs 8 which are at a standstill in the stationary row can undergo any processing operation. In the case of an aseptic treatment, for example, they are supplied with gas so that the inside of the pack 8 is sterilized; or other processing operations take place. In Position I, the standstill time of the row of packs 8 is three seconds.

The row of packs 8 is then moved in the direction of the arrow 11 into Position II in FIG. 1. This is done by way of the transverse sliding conveyor which is not shown nor described in greater detail here, since conventional carriers can be used for this movement. Transfer from Position I to Position II takes place within the space of a second.

The so-called intermediate conveyor is, in turn, a continuous belt with direction-changing rollers on vertical axes, and it is labelled 12 here. It rotates in the direction of the curved arrow 13, and is likewise controlled in such a way that it is driven discontinuously. When it moves, the row of packs is then moved from Position II in FIG. 1, to the left, into Position III. In that position, a previously empty transportation box 14 is now filled. The arrangement of gripping devices of the intermediate conveyor 12 is depicted as radially spaced apart fingers, and the construction of the feed conveyor 3 and also of the carry off conveyor 25 are the same. With respect to the gripping engagement height, it can be imagined from looking at FIG. 3, that the gripping fingers engage over the upper edge of the transportation boxes 14, so that rows of packs 8 can be introduced into, or removed from, the transportation boxes 14, without the gripping fingers themselves touching and engaging with the transportation boxes.

In Position III, the row of packs 8 remains in the transportation container 14 for three seconds. This container is made of a plastics material, for example, and has good sliding properties and good stability properties. It has also taken three seconds for the row of packs 8 to move from Position II into Position III. During the three seconds that the row of packs remains in Position III, no processing operations are carried out in this so-called first intermediate position. With a further development to the machine, appropriate manipulations can be carried out to the packs here. The transportation box disposed in the first intermediate Position III is thus provided with a row of packs 8 and is then pushed into the Position IV in the transverse direction of conveyance 15 by the second transverse conveyor. This is the second intermediate position in which the second transverse conveyor stops after movement lasting one second.

If FIG. 1 is studied, then three transportation boxes 14 are to be seen in the left two thirds of the housing 9, wherein the second transverse conveyor is to be imagined as being disposed beneath the three right transportation boxes 14, and the third transverse conveyor is to be imagined as being disposed beneath the three left transportation boxes 14. The two direction-changing wheels of the second transverse conveyor are marked in FIG. 2 beneath the level of the base 2 by the reference numeral 105, and that of the third transverse conveyor is labelled 106. Since it is easy to imagine the design of the transverse conveyor with a continuous belt, the reference numerals 105 and 106 are also used to designate the second 105 and the third 106 transverse conveyors. Movement of the packs into Position IV is a very careful engagement process because only the outer U-shared transportation container 14 is held, and it is only moved through a small path into Position IV in the transverse direction of conveyance 15, for which one second is enough time for this to happen.

From FIG. 2 it can be seen that Position IV is that beneath the filler tubes 16 of a filler station, generally denoted by the reference numeral 17. In this Position IV it is possible to see in FIG. 2 the way in which the packs 8, with their transportation containers 14, can be moved freely in every direction beneath the filler tubes 16. The lever 18 which can also be seen in FIG. 4 can now begin to lift the transportation container 14, by way of cam controls or a cam, in a vertically upward direction. Therein, the transportation container 14 obviously remains in Position IV in FIG. 1 with the packs 8. During this movement, the filler tubes 16 plunge into the hole in the upper surface of the pack 8, so that the pack which embraces the filler tube 16 is pushed up over this until it reaches a maximum upper position. The valves of the filler device 17 are then opened, and the filling process begins. The row of packs 8, together with the transportation container 14, is slowly lowered during the filling process. This happens by controlling the lever 18, and by way of cams or cam controls 19. After the filling process has been completed, the row of packs 8 is disposed once again at the height shown in FIG. 2. The upper surface of the pack is thus once again completely freed from the bottom end of the filler tubes 16. The packs which are once again in Position IV are now completely filled, but they are still open. The filling process takes place within the space of three seconds. i.e. the packs are lifted, filled and lowered.

The filled row of packs is then transported in the transverse direction of conveyance in the direction of the arrow 15', in a direction into Position V. One second is available for this to happen.

The next stage is conveyance of the row of packs 8 in the transportation box 14 in the longitudinal conveyance direction, parallel to the arrow 4, into the Position VI, i.e. beneath a row of pouring devices which are supplied parallel to one another, transversely to the direction of conveyance 4, in the form of strips, as can be seen clearly in FIG. 1. Three seconds is available for the packs to move into Position VI. That is a lot of time for a distance of 1 m between Positions V and VI. Thus, the movement is precision-made which means that the liquid inside the packs cannot spill through the open hole.

With respect to FIG. 2, the transportation container 14 is disposed with the packs 8 beneath and in front of an elongate, rotatable receiving device 20, namely a receiving device for the pouring devices which are supplied in strip form, e.g. ten next to one another, to Position VII. The strip of pouring devices thus moves over Position VI.

Within the space of a second, the transportation box 14 is pushed opposite to the direction of the arrow 15' into Position VII. This is shown in FIG. 2. Disposed beneath the elongate and rotatable receiving device 20 is a row of packs 8 at a standstill. Position VII is exactly vertically below the shaft of this elongate receiving device 20, which is rotatable in stroke motion about its longitudinal axis.

Just as with the above-described filling process in Position IV, here too, in Position VII (also shown in FIG. 2), push rods 21 and a similar cam movement like in Position IV are used to lift the whole transportation box 14 with the filled upwardly open packs 8, and to push the pouring devices which sit on the mandrels 22 of the receiving device 20, and which are provided with a hot melt fibre. The following then happens within the space of three seconds: the transportation box 14, together with the packs 8, is lifted up; it remains for a short space of time in this position, so that the hot adhesive thread which is arranged on the outside of the pouring device can cool on the edge of the upper surface and be fixed there. The row of packs is then lowered back into the previous position, as shown in FIG. 2. Only then, if the packs 8 have thus arrived in the position shown in FIGS. 1 and 2, Position VII, are the aforementioned three seconds over.

The next transportation stage in the direction of the arrow 24 into Position VIII takes place within the space of one second by means of the third transverse conveyor 106.

The transportation box 14 remains in Position VIII for three seconds. This is sufficient time for the packs 8 to be transported away or transported in the direction of the arrow 4, to the left and out of the box. The conveyor belt 25 is similar to the intermediate conveyor 12 which likewise rotates in the direction of the curved arrow 13. The transportation container 14 comes to a standstill in Position VIII, whilst the row of packs 8 moves to the left through a separating device, generally designated by the reference numeral 26. This separating device moves synchronously with the carry off conveyor 25 and separates the packs 8 which are shown individually in the left end Position IX. The separating device 26 has blades which press on the hard companion layers, so that the hard edges blast the intermediately disposed relatively hard and brittle material.

Within the space of a further second, the transportation box 14 is moved out of Position VIII by means of the third transverse conveyor 106 in the direction 24 into Position X.

After the space of one second, when the empty transportation box 14 has arrived in Position X, it does not remain there, i.e. it does not remain there at a standstill for three seconds, but it is moved within these three seconds to the right in the direction opposite to the direction of longitudinal conveyance, and into Position XI. It will be noted that in FIG. 1 the Positions VI and XI are marked by broken lines. This is an instantaneous photograph of the two transverse conveyors 105 and 106 at a position where the two places marked by broken lines are empty. Thus, when the row of packs 8 is being taken from Position VIII by the carry off conveyor 25, the transportation box 14 is already being pushed into Position XI. The empty transportation box 14 is thus displaced in the space of three seconds.

The entrainment devices 27' and 28 are thus disposed beneath the Positions V and VI and X and XI.

From Position XI, the empty transportation box 14 is immediately returned to Position III and it remains there for three seconds, during which time it is loaded from the right with another row of packs 8.

Both the first entrainment device 27' and the second entrainment device 28 extend over the entire length of the two transportation boxes 14 which are disposed behind one another, i.e. across Positions V and VI, and the device 28 extends over the Positions X and XI. These entrainment devices 27' and 28 are disposed beneath the base 2, however, and they are thus beneath the contact surfaces of the transportation boxes. The entrainment members 29 which project from the empty belt of the continuous belt of the entrainment device 27' or 28 engage in recesses, not shown, on the upper surface of the transportation boxes 14, e.g. when the transportation box 14 is disposed in Position X. If the entrainment device 28 then moves in the counter longitudinal direction of conveyance, thus in the direction opposite to the arrow 4, then the second entrainment device 28 conveys the transportation box 14 in the direction of the arrow 27 to the right into Position XI. This transition happens within the space of three seconds.

Figure 4:
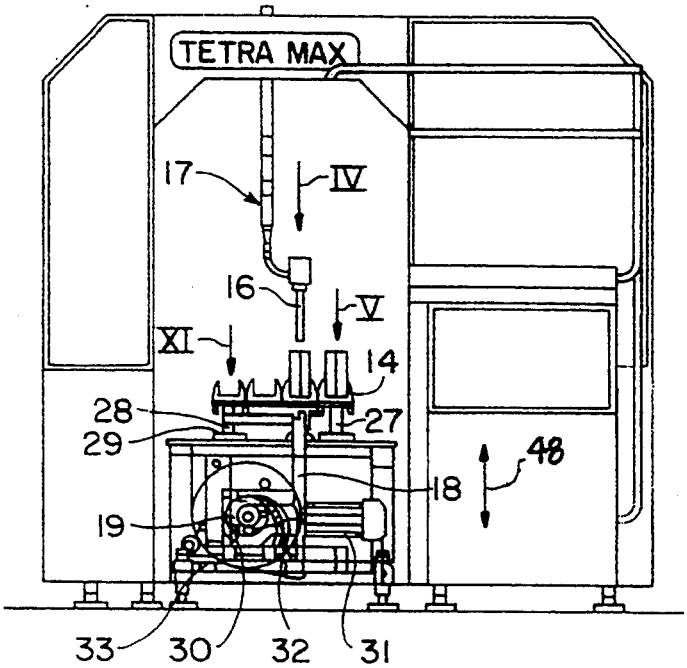
FIG. 4 shows a similar sectional view to FIG. 3, but along the line IV—IV in FIG. 2.

FIG. 4 shows the continuous belt of the first entrainment device 27' to the right, and of the second entrainment device 28 to the left with the entrainment members 29.

FIG. 4 shows Positions XI and V as the two end positions. The transportation box 14 is moved, in Position IV, so that it is directly beneath the filler tube 16, so that the filling process can begin. In FIG. 4 it is also possible to see the cam 30 which is driven by the motor 31 and also a cam 32 which, by way of a lever 33, moves the push rod 18 in the direction of the double arrow 48 upwards and then back down later on.

Figure 5:
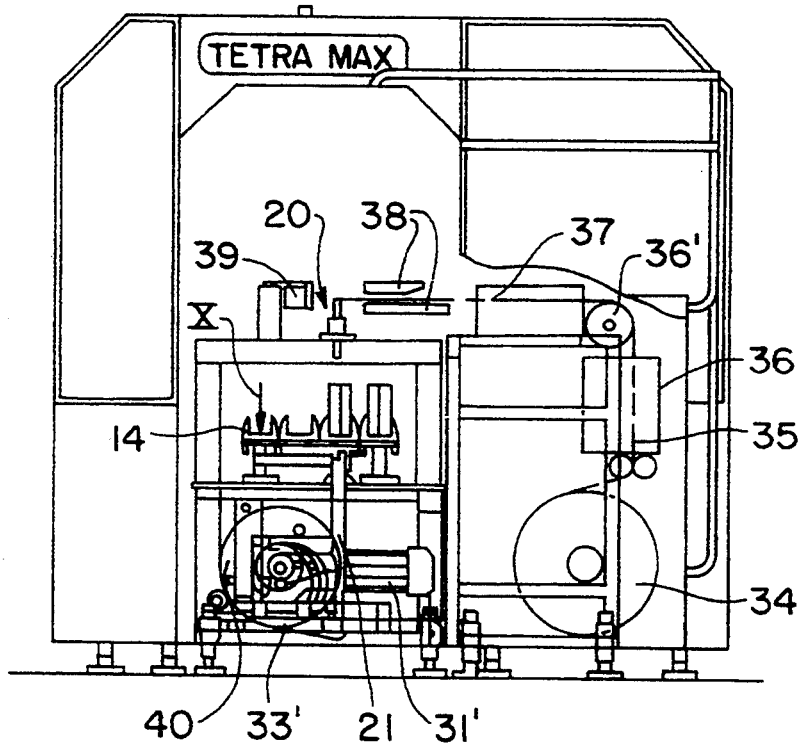
FIG. 5 shows another similar sectional view along the line V—V in FIG. 2.
Figure 6:
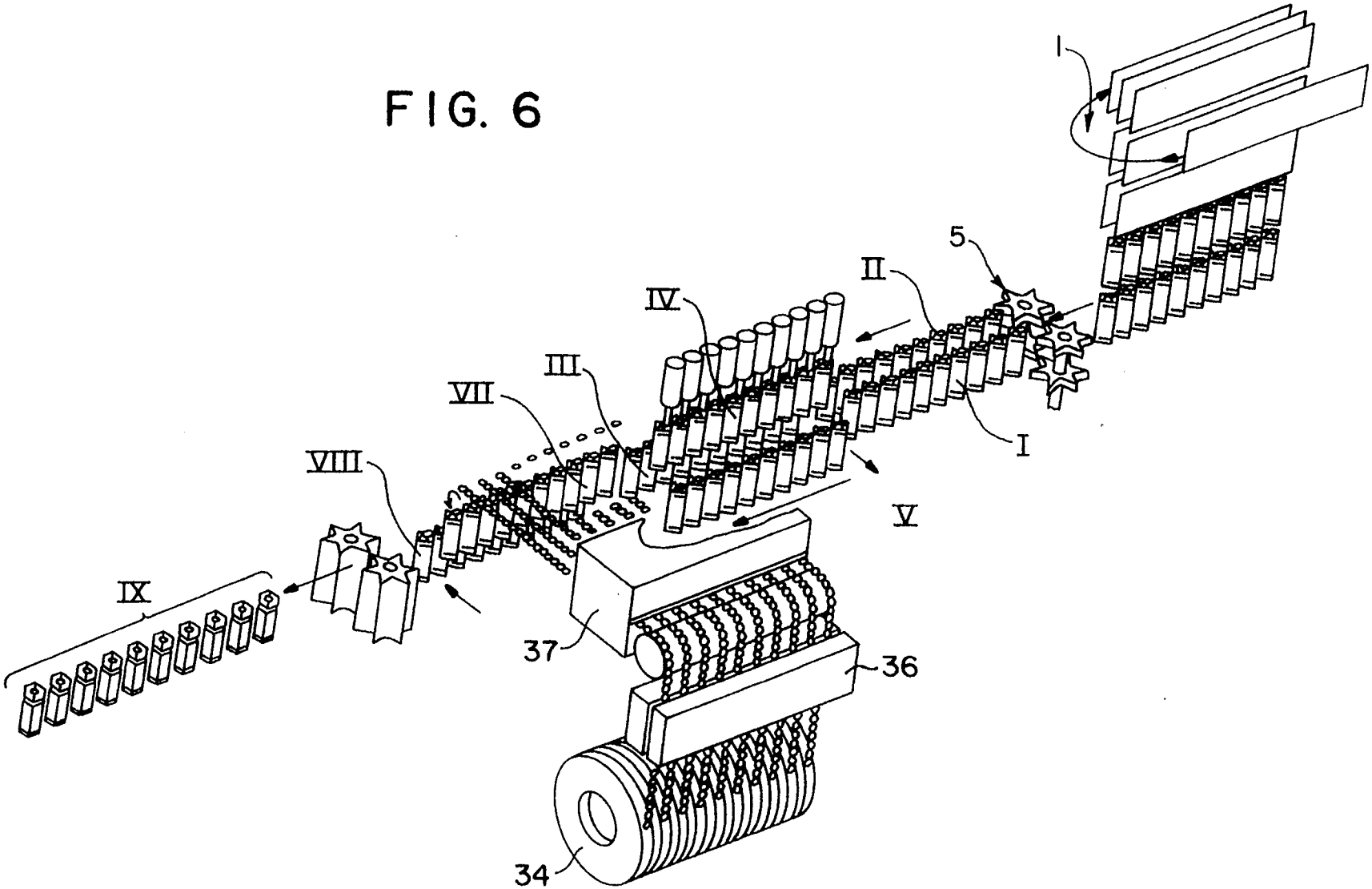
FIG. 6 shows an illustration in a perspective view of the path of movement of the row of packs.

FIG. 5 differs from FIG. 4, amongst other things, in that a roller 34 is shown in FIG. 5 with ten rollers disposed behind one another, as seen above in FIG. 2. A strip 35 of pouring devices is wound around each roller. According to FIG. 5, this strip is drawn up over a direction-changing roller 36'. Therebetween is a heating and deep-drawing device 36 with compressed air for making the pouring devices. However, it is also possible to work in other ways with the pouring devices which are already present.

The strip 35 of the pouring devices passes to a sterilising device 37 to the left in FIG. 5, and is guided via guides 38 to the above-mentioned receiving device 20. With one particular embodiment, hot melt threads are applied to the pouring devices using an adhesive applicator device 39.

FIG. 5 shows the push rod 21 which is driven by a common motor 31 or also by individual motors for each unit and by means of a cam disc 40, so that it can be moved up and down by the lever 33'.

Figure 7:
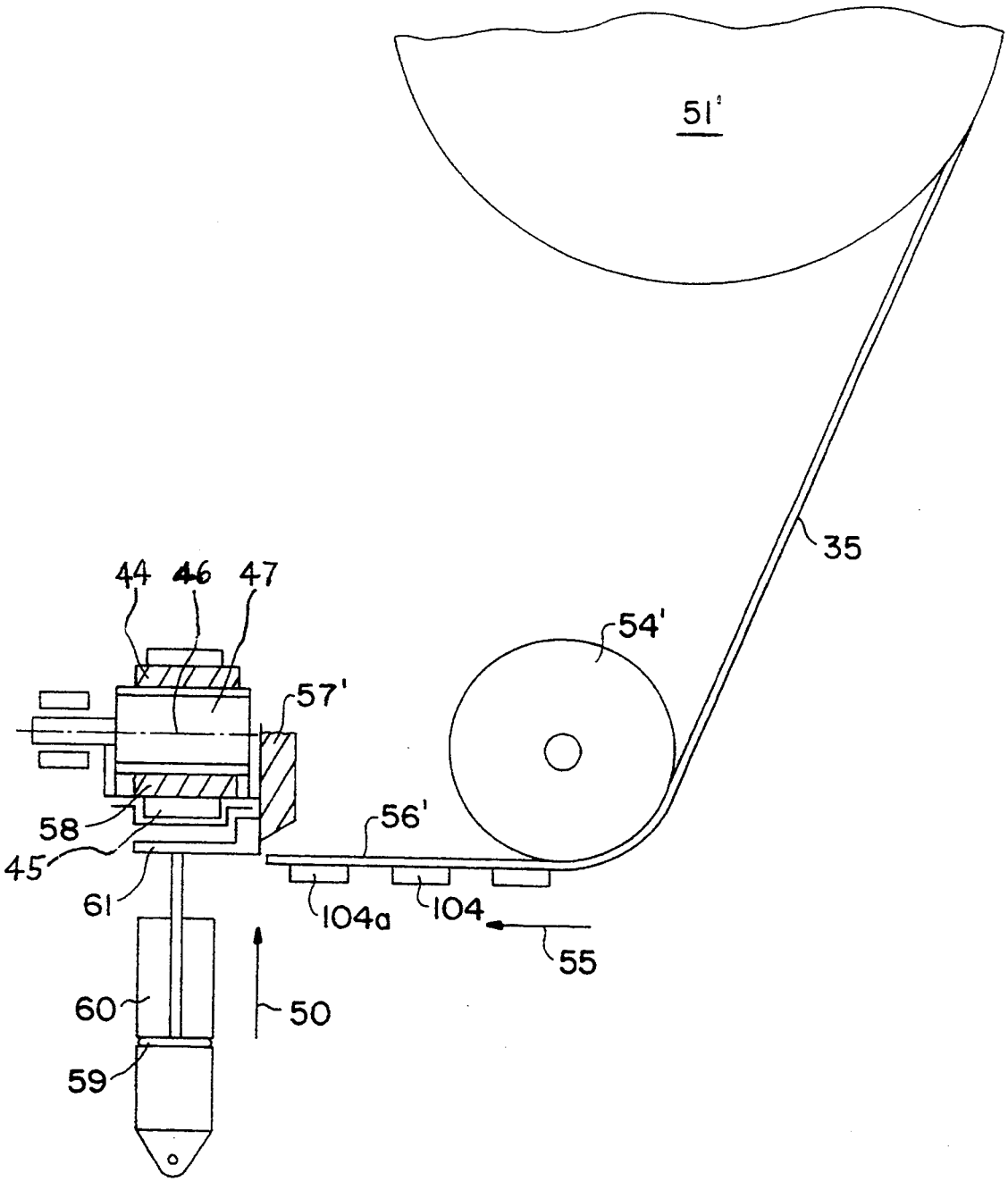
Figure 8:
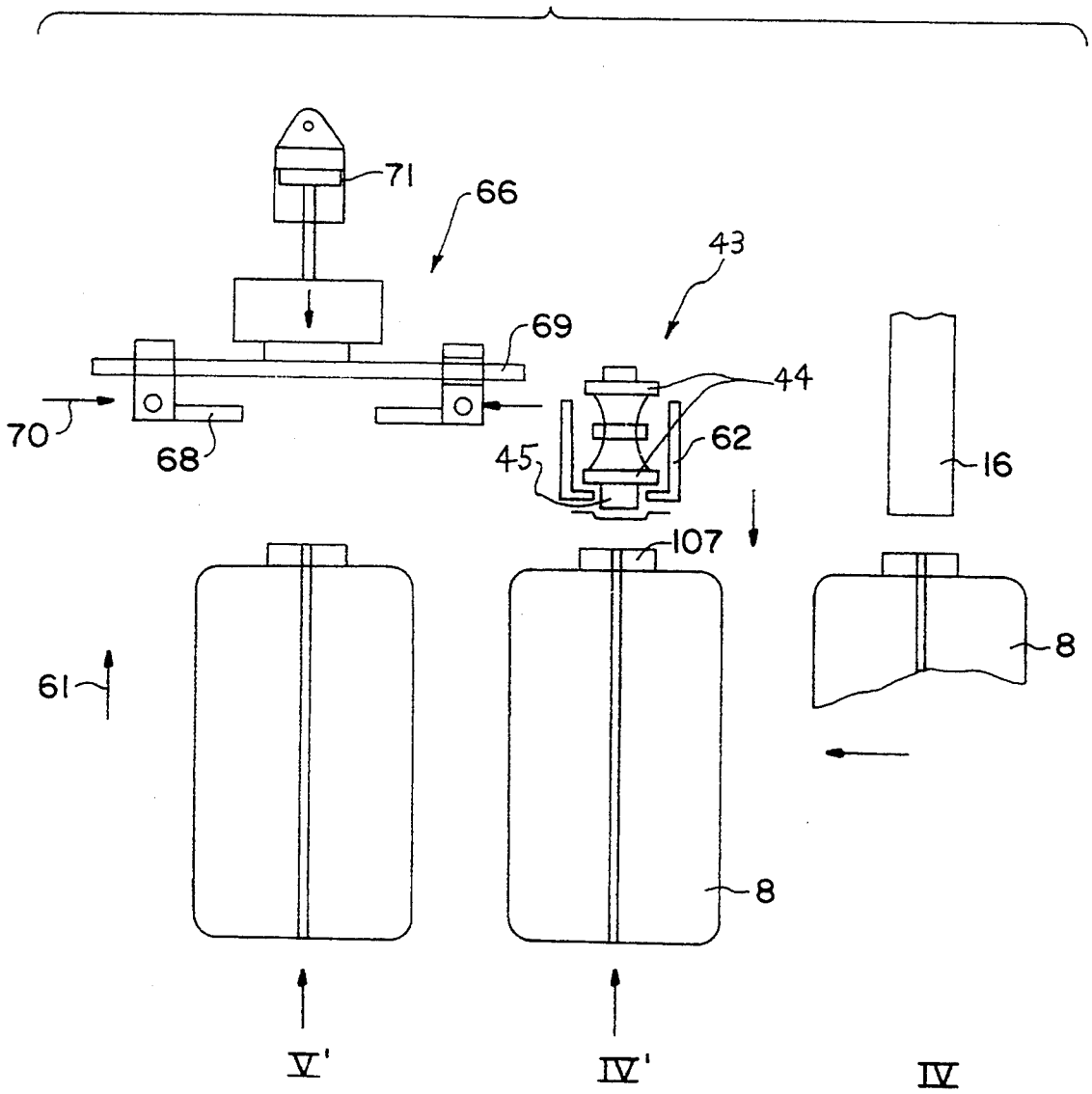
Figure 9:
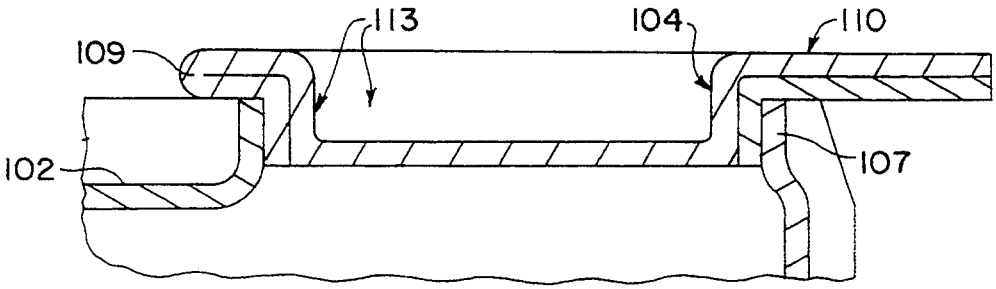
FIGS. 9 to 11 show broken away vertical cross-sectional views and plan views of a pouring device which can be arranged on a cylindrical casing like upwardly projecting edge with holes on the upper surface of a pack, FIG. 9 in the closed condition, FIG. 10 from above and FIG. 11 in the open condition in a cross-sectional view, like that in FIG. 9, and FIG. 12 finally shows the perspective view of a pack which is made entirely of plastics material and which has a pouring device placed thereon, but opened.
Figure 10:
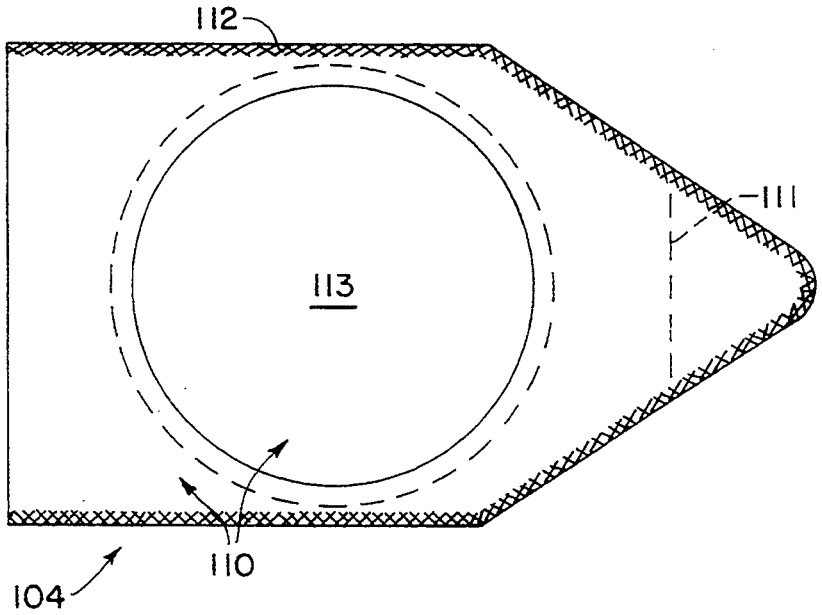
Figure 11:
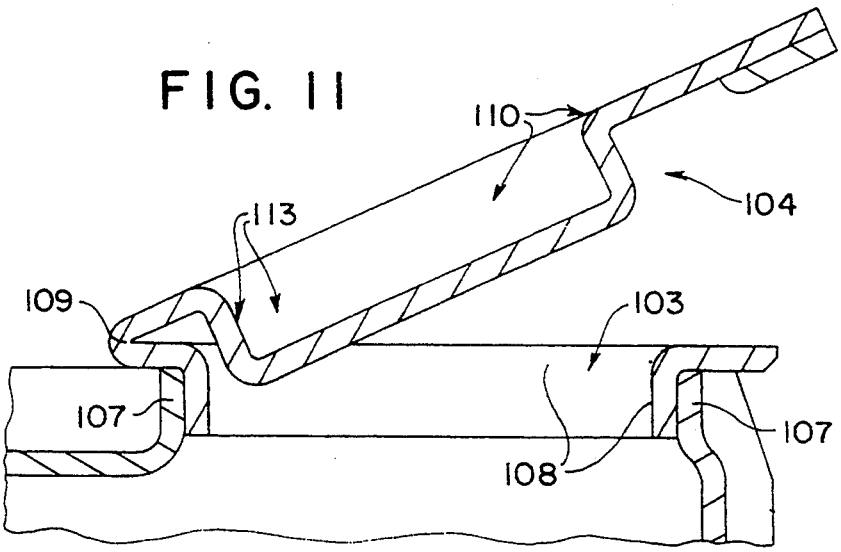
Figure 12:
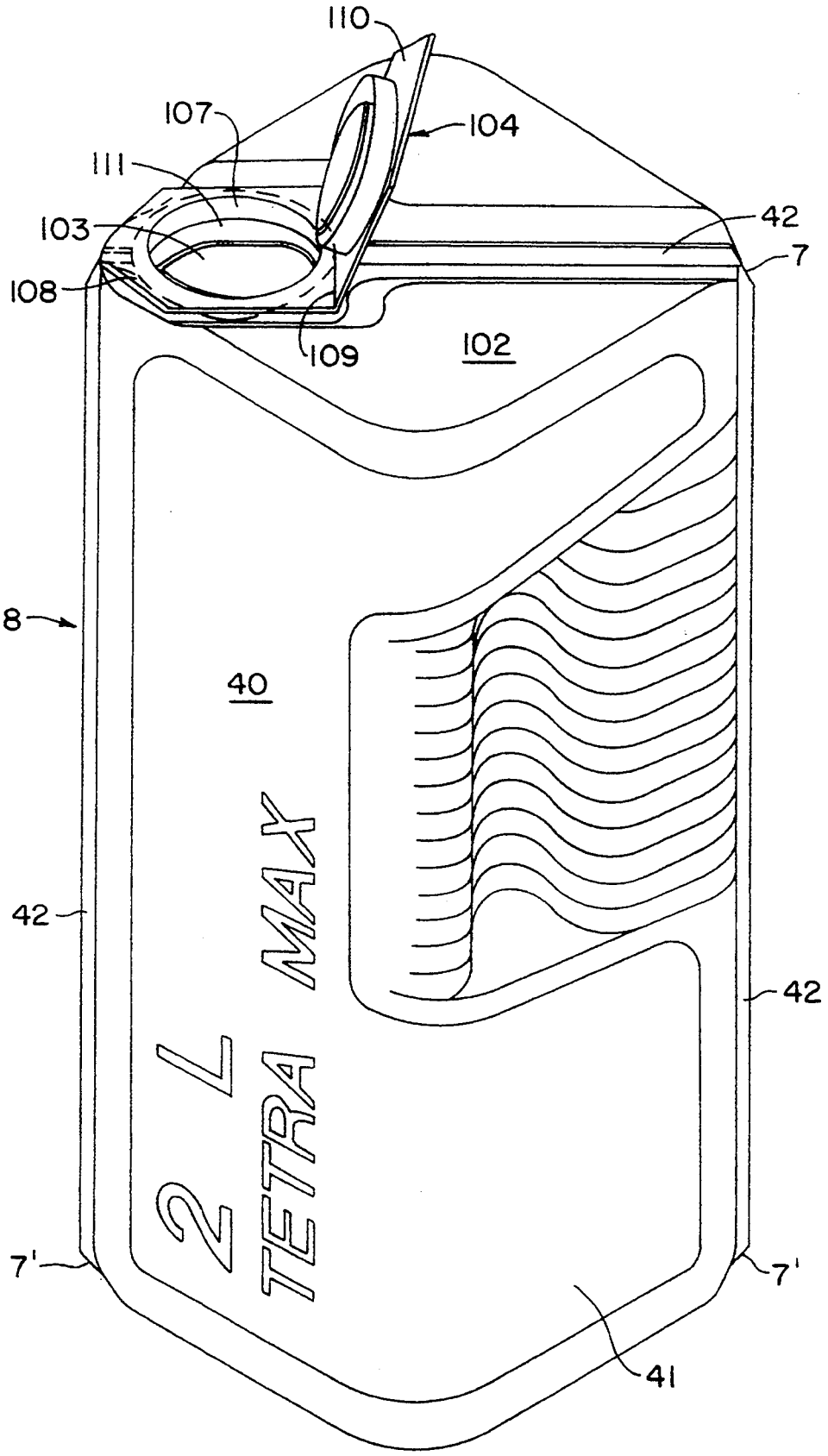

FIGS. 7 and 8 show another embodiment of a pouring device 104, 104*a*. With this second embodiment for applying and welding other types of pouring devices to the top surface of the pack 8, a second conveyor 43 must be imagined which has a continuous belt 44, on which belt clamping receivers 45 are disposed. In FIG. 7 it is possible to see the axis 46 of a direction-changing roller 47. The holding means of the pouring devices 104, 104*a*, to be described briefly with the aid of FIGS. 9 to 12, are for the clamping receivers 45. In FIG. 12, the pack 8 is shown with the front two side walls 40 and 41 and also with the flat upper surface 102. This pack 8 was formed from two halves which were welded together along a peripheral seam 42, wherein an opening 103 with a peripheral edge 107 was formed in the upper surface 102. The pouring device which is generally labelled by the reference numeral 104 is welded, in this embodiment, to the edge 107 of the opening or of the hole 103 in the upper surface 102. The device consists of a bottom part 108 and a stopper 110 which is joined to the bottom part by a hinge 109. FIG. 9 shows the pouring device 104 in the closed condition, which is also to be seen in the plan view in FIG. 10. After opening, the stopper 110 is opened up in the way shown in FIG. 11, wherein the hole 103 of the pack 8 then communicates with the outside and the pack can be emptied. This condition is also to be seen in perspective in FIG. 12.

Figure 3:
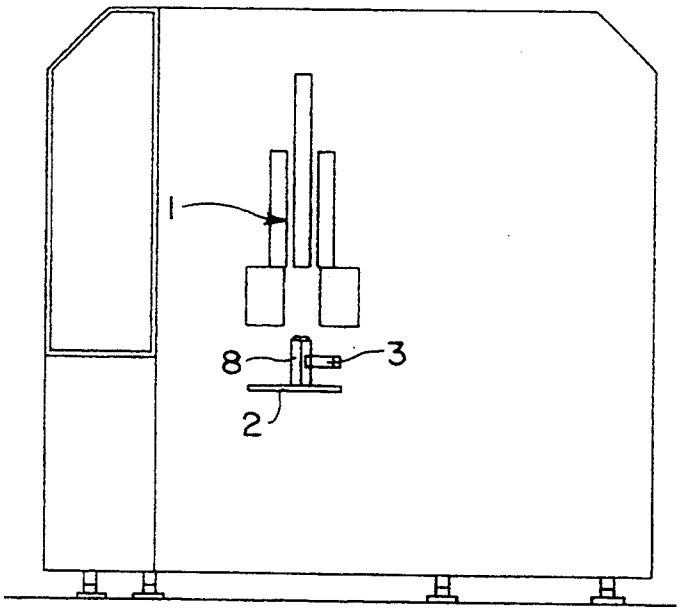
FIG. 3 is a sectional view approximately along the line III—III in FIG. 2.

Although nominal break lines 111 and sealing seams 112 are opened in opening the pack. it is to be appreciated that the premanufactured separate pouring device 104 is manufactured with unbroken lines 111, 112 in the closed condition shown in FIG. 9, and is stored. A ready made pouring device 104 such as this which is to be placed in the hole to close the pack is shown in the plan view in FIG. 10. A cup-shared recess 113 can be seen, which, according to FIG. 3, is pushed over the cylindrical casing-like clamping receiver 45 from the bottom to the top, in the direction of the arrow 50, onto the receiver 36.

A strip 35 of e.g. 2000 pouring devices 104 disposed behind one another is disposed on the coiled roller 51', whilst another roller, not shown, is arranged behind it. This strip 35 is drawn off from the roller 51', and after passing over the direction-changing roller 54' arranged therebeneath (FIG. 7), it is fed in the direction of the arrow 55 horizontally on the track 56' to a drivable separating blade 57'. When the frontmost pouring device 104 has reached the position 104*a* (FIG. 7), the piston 59 of an air cylinder 60 is disposed in the bottom oscillating position, or it moves directly opposite to the arrow 50 in a downwards direction. This left pouring device 104 is then moved from the position 104*a* through a step to the left directly over a slider 61 which has a bottom blade at the end associated with the separating blade 57'. When the pouring device 104 is disposed in the position to the left of that of the device 104*a*, then the air cylinder 60 can be actuated, and the piston 59 can be pushed up by the slider 61 in the direction of the arrow 50, wherein, first of all and on the one hand, the pouring device 104 disposed furthest to the left is separated from the strip 35, and individualised. It is then pushed up in the direction of the arrow 50 onto the clamping receiver 45 on the empty belt 58 of the continuous belt 44. The clamping receiver 45 is then pushed into the cup-shared recess 113 of the pouring device 104, and fixes this to the continuous belt 44. During a stroke movement lasting one second, one empty clamping receiver 45 is positioned above the air cylinder 60 with the separating blade 57 every second, and a clamping receiver 45 can be provided with a pouring device 104 every second.

Position IV is shown to the right in FIG. 8, in which position the pack 8 is disposed beneath the filler tube 16. To the left of it is Position IV' wherein the pouring devices are pushed by the clamping receivers 45 by means of the stripper rails 62 into the edge 107 of the upper surface of the pack 8.

Welding of the pouring device is to be carried out in Position V'. A lifting mechanism, not shown in greater detail, is used to lift the pack 8 in the direction of the arrow 61. Heating jaws 68 are arranged on a guide rod 69 so that they can be moved in the direction of the arrow 70, and they are responsible for pre-heating the plastics parts which are to be welded together before the necessary counter pressure is provided by heating jaws and counter jaws which are actuated by an air cylinder 71, for the positioned pouring device 104 to be firmly welded to the edge 107 of the hole 103 in the upper surface 102.

After being lowered onto the base 2 in Position V', the row of packs is then filled and firmly closed with the pouring devices 104 welded thereto, so that, like with the embodiment in FIG. 1, they can be brought into the end Position IX by a carry off conveyor.

We claim:

1. A device for filling and closing a plurality of packs for liquids, wherein said packs are arranged in an integral package in a row with each individual pack adhered to an adjacent pack, wherein each of said packs has an upper surface adapted to be joined to a pouring device, and wherein said upper surface has an opening therein, wherein the device comprises:

a) a first feed conveyor (3) having a feed conveyor base (2) for moving an integral package of open, empty packs (8) in a first direction of conveyance (4), from a shaping device (1) to a first position (I) located at one end of said first feed conveyor;

b) a continuous belt intermediate conveyor (12) arranged parallel to said first feed conveyor (3) and having a first end located proximate said first feed conveyor (3), also arranged to move the package in said first direction of conveyance;

c) a first transverse sliding conveyor positioned transversely to said first feed conveyor (3) and said continuous belt intermediate conveyor (12) and operatively arranged to intermittently move the package from said first position on said first feed conveyor in a second direction (24), which is transverse to said first direction of conveyance, to a second position (II) located at the first end of said continuous belt intermediate conveyor (12), said continuous belt intermediate conveyor (12) operatively arranged to move said package in said first direction of conveyance from said second position (II) to a third position (III) located at a second end of said continuous belt intermediate conveyor (12);

d) a plurality of transportation boxes (14) for receiving said package in said third (III) position, which transportation boxes are intermittently moved by entrainment devices (27', 28) in a closed loop within said device, wherein said transportation boxes are each upwardly open containers of U-sharped cross-section and have substantially closed bottoms, which boxes are operatively arranged to hold and transport said package, wherein said entrainment devices and transportation boxes are operatively arranged to move in said closed loop in only one direction, wherein once the transportation boxes are initially filled with said packages, the boxes remain filled with packages and never move empty of packages within said device until the final package is removed from the device;

e) a second transverse conveyor (105) located beneath said feed conveyor base, for moving said transportation boxes in a third conveyance direction (15), opposite said second direction, from said third position to a filling location within said device, which location is defined as a fourth (IV) position, and for moving said boxes in said third direction to a holding location after filling, which holding location is defined as a fifth (V) position;

f) a filler station (17) operatively arranged to fill said empty packs when said package is in said fourth (IV) position;

g) a stoppering station operatively arranged to close and seal said packs;

h) a third transverse conveyor (106) located beneath said feed conveyor base for transporting said boxes of packs into a position under said stoppering station; and, i) a carry off conveyor (25), for removing said filled packs from said device.

2. A filling device as recited in claim 1 wherein said second and third transverse conveyors are positioned adjacent one another and are operatively arranged to convey said transportation boxes in opposite directions, and wherein said second transverse conveyor intermediately positions said boxes under said filling station and said third transverse conveyor intermediately positions said boxes under said stoppering station.

3. A filling device as recited in claim 1 wherein said entrainment devices comprise two entrainment devices which respectively convey in opposite directions so as to bring the transportation boxes from one transverse conveyor to the other.

4. A filling device as recited in claim 1 wherein said entrainment devices have entrainment members which engage openings in said transportation boxes.

5. A filling device as recited in claim 1 wherein all conveyors and entrainment devices are arranged within an aseptic space closed off by a housing.

6. A filling device as recited in claim 1 characterized in that arranged adjacent to the stoppering station, at a distance therefrom, is at least one roller with a wound up strip of pouring devices with a rotating axis arranged horizontally in the direction of conveyance of the feed conveyor.

7. A filling device as recited in claim 1 characterized in that each filler device of the filler station has at least one vertically downwardly extending filler tube, wherein said filling device further comprises a lifting mechanism for lifting a row of packs into engagement with said filler tubes.

8. A device as recited in claim 1, characterized in that the stoppering station has conveyance means for pouring devices to be placed on filled packs, which pouring devices have a continuous strip of outwardly projecting, springy clamping receivers, characterized in that in a region of an empty belt of a continuous belt which is movable proximate the packs are stripper rails which are movable vertically and which contain vertically movable sliders operatively arranged to push the pouring device onto the clamping receivers.

9. A filling device as recited in claim 8, characterized in that the stoppering station has two processing stations arranged transversely adjacent to each other, of which the first processing station is provided for positioning the pouring device by means of the third transverse conveyor, the clamping receiver and the stripper rails, and of which the second processing station is provided for arranging the pouring device which is placed in the opening of the upper surface of the pack, wherein this second processing station has another lifting mechanism for the row of packs.

* * * * *